US007314370B2

(12) United States Patent
Chian et al.

(10) Patent No.: US 7,314,370 B2
(45) Date of Patent: Jan. 1, 2008

(54) AUTOMATED OPERATION CHECK FOR STANDING VALVE

(75) Inventors: Brent Chian, Plymouth, MN (US); Donald J. Kasprzyk, Maple Grove, MN (US); Sybrandus B. V. Munsterhuis, Dalen (NL); Timothy J. Nordberg, Bloomington, MN (US); Willem Vander Werf, Brooklyn Park, MN (US); Robert L. Zak, St. Paul, MN (US); Andres Waszczenko, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 122 days.

(21) Appl. No.: 11/023,243

(22) Filed: Dec. 23, 2004

(65) Prior Publication Data

US 2006/0141409 A1 Jun. 29, 2006

(51) Int. Cl.
*F23N 1/00* (2006.01)

(52) U.S. Cl. ..... 431/89; 431/24; 431/75

(58) Field of Classification Search ..... 431/75, 431/89, 8, 14, 27, 290, 77, 84, 24, 12; 126/348
See application file for complete search history.

(56) References Cited

U.S. PATENT DOCUMENTS

| | | | | |
|---|---|---|---|---|
| 4,197,082 | A * | 4/1980 | Matthews | 431/25 |
| 4,260,362 | A * | 4/1981 | Matthews | 431/69 |
| 4,459,099 | A * | 7/1984 | Grunden et al. | 431/27 |
| 5,026,270 | A * | 6/1991 | Adams et al. | 431/24 |
| 6,280,180 | B1 * | 8/2001 | Fredin-Garcia-Jurado et al. | 431/27 |
| 6,419,478 | B1 * | 7/2002 | Kemp | 431/12 |
| 2005/0130086 | A1 * | 6/2005 | MacNutt et al. | 431/14 |

* cited by examiner

*Primary Examiner*—Steve McAllister
*Assistant Examiner*—Chuka C Ndubizu

(57) ABSTRACT

A method of verifying proper operation of an electromagnetic valve. The method includes providing a mechanism to effect opening of the valve, verifying that the valve opened as a result of employing the mechanism to effect opening of the valve and after verifying the valve opened, signaling the valve to close after a first period of time has elapsed. The method further includes, after signaling the valve to close, signaling the valve to re-open after a second period of time has elapsed and detecting the occurrence or non-occurrence of an event associated with the closing or re-opening of the valve.

25 Claims, 5 Drawing Sheets

AUTOMATED OPERATION CHECK FOR STANDING VALVE

FIELD

The present invention relates generally to valve control and, more specifically, to automatically verifying proper operation of a valve.

BACKGROUND

Valve control circuits are prevalent in gas-powered appliances, such as water heaters, furnaces and fireplaces. Such gas-powered appliances may use a self-powered control circuit and/or valve system. In one approach, a thermally activated power source is used to provide electrical power to the control circuit and/or system. Such thermally activated power sources typically have limited voltage potential as well as current generating capacity. Thus, gas-powered appliances using such a thermally activated power source typically use millivolt gas valves to control the flow of gas (e.g., natural gas, propane). For example, in a water heater application, a thermally activated power source may be used to power a low-power control circuit that controls a pilot valve and a main burner valve for the water heater. As was just indicated, these valves are typically millivolt valves, which may be operated with voltages in the millivolt range.

A common arrangement in gas-powered appliances is to employ two gas valves, one valve for a pilot light burner and one valve for a main burner. The pilot light acts an ignition source for the main burner when its valve is opened by the control circuit (e.g., when water in a water heater is to be heated or when a furnace begins a heating cycle). Further, the pilot light also provides thermal energy to the thermally activated power source to power the control circuit and operate the valve(s). The pilot valve in such appliances typically operates as what may be termed a standing pilot valve. A standing pilot valve, when the appliance is in service, remains open to provide for a continuous pilot light to produce electrical power (for the control circuit) and to provide an ignition source for the main burner when its valve is opened by the control circuit.

In such applications, the pilot valve may remain open for long periods of time (e.g., months or years) while the appliance in which it is employed is in service. In the event the pilot valve becomes mechanically stuck in an open position, such as due to corrosion or mechanical failure, a safety concern may be presented. For example, if the pilot flame is somehow extinguished (e.g., due to airflow extinguishing the flame or a temporary loss of gas flow) and gas flow continues or is restored, gas vapor would be continuously emitted into the area where the appliance is installed, thus creating an explosion and or fire danger.

Currently, in order to verify the proper mechanical operation of such gas valve, an appliance in which the valve is employed is taken out of service to verify that the valve closes as expected. Such a technique requires interruption of the operation of the appliance; depends on human intervention and, thus, may go unattended, creating the possible safety risks that were previously described. Therefore, other techniques for periodically verifying the proper operation of a gas valve are desirable.

SUMMARY

A method of verifying proper operation of an electromagnetic valve is provided. The method includes providing a mechanism to effect opening of the valve, such as a mechanical actuation mechanism. After the valve is initially opened, the method includes verifying that the valve opened as a result of employing the mechanism to effect opening of the valve. Such verification may include receiving a voltage signal with a controller, where the voltage signal is produced by a thermoelectric device in thermal communication with a pilot light flame generated using gas emitted from the valve. Such a method of detection may be quite time consuming due to the response time of available thermoelectric devices. The pilot flame may be ignited in conjunction with mechanical actuation of the valve, such as with a piezo igniter. The method further includes, after verifying the valve opened, signaling the valve to close after a first period of time has elapsed. This period of time may be any appropriate time period, for example one hour, twenty four hours, one week, or a month.

After signaling the valve to close, the method includes signaling the valve to re-open after a second period of time has elapsed. This second time period is on the order of, for example, twenty to forty milliseconds. The second time period is a period of time that allows for closure of the pilot valve without extinguishing the pilot light completely. Thus, in a typical application, the second period of time will be substantially shorter than the first period of time. Proper operation of the valve is determined by detecting the occurrence or non-occurrence of an event associated with the closing or re-opening of the valve. Such an event may be an inductive current spike associated, respectively, with the closing or opening of the valve. Such a technique allows for periodic verification of proper operation of a standing pilot valve without the need to take the appliance out of service and also reduces the likelihood that mechanical failure of the valve will result in the risk of explosion or fire hazard.

These and other aspects will become apparent to those of ordinary skill in the art by reading the following detailed description, with reference, where appropriate, to the accompanying drawings. Further, it should be understood that the embodiments noted in this summary are not intended to limit the scope of the invention as claimed.

BRIEF DESCRIPTION OF THE DRAWINGS

Exemplary embodiments are described herein with reference to the drawings, in which.

DETAILED DESCRIPTION

While the embodiments discussed herein are described in general with respect to use in gas-powered appliances, it will be appreciated that other embodiments are possible. For example, such techniques may be employed with valves used in industrial applications to verify proper function of such valves. Furthermore, it will be appreciated that many of the elements described herein are functional entities that may be implemented as hardware, firmware and/or software, and as discrete components or in conjunction with other components, in any suitable combination and location.

Figure 1:
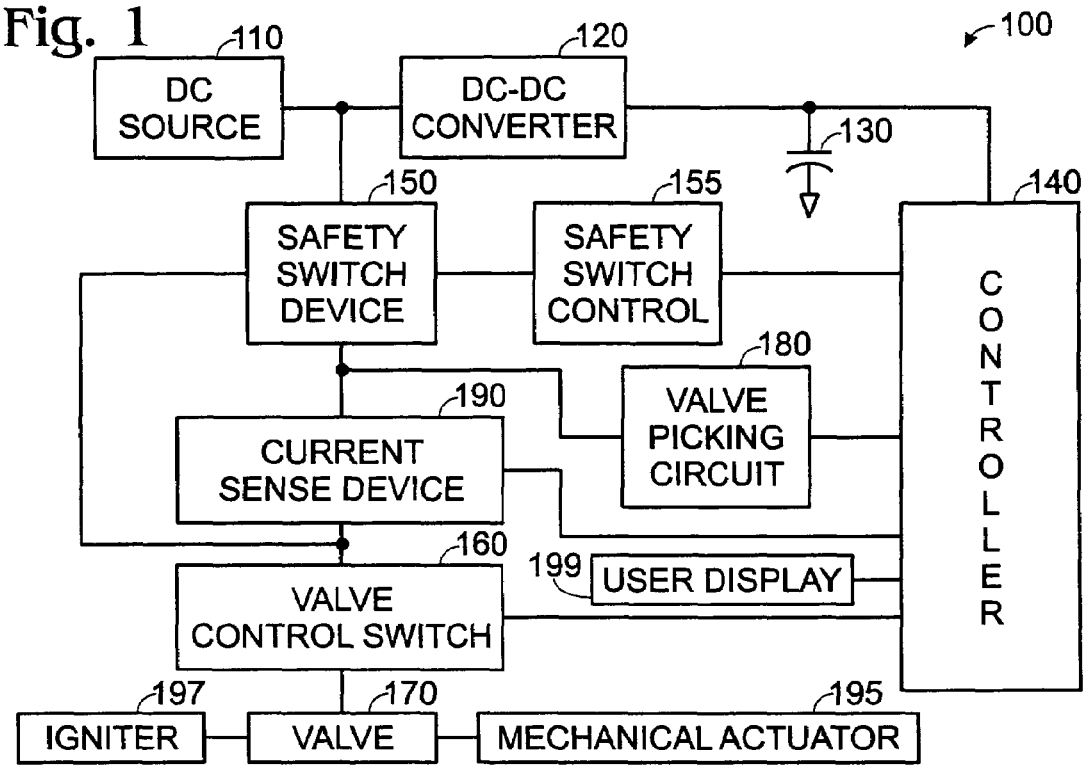
FIG. 1 is a block diagram illustrating a valve control system with automatic valve operation verification features.

Referring now to FIG. 1, a block diagram of a control system 100 for valve control that includes valve operation verification features is shown. For purposes of clarity, the operation of the valve control features of the system 100 is first discussed generally to provide an understanding of how the system 100 is employed to open and close a valve. Then, in this context, the valve operation verification features of the system 100 are generally discussed. Further, both of these aspects of the system 100 are discussed in further detail below with respect to FIGS. 2-6.

The system 100 comprises a direct current (DC) voltage source 110. The DC source 110 may be, for example, a thermally activated DC voltage source. Such thermally active voltage sources include thermopile devices, which typically include serially coupled thermocouple devices. Thermopile devices are typically used in the control systems of, for example, gas powered appliances, such as water heaters.

For the system 100, the DC source 110 is coupled with a DC-to-DC (DC-DC) converter 120. For this particular embodiment, the DC-DC converter 120 comprises a step up converter, which may be a single stage converter or a multi-stage converter, depending on the particular application. The DC-DC converter 120 is coupled with a charge storage device 130, which for the system 100 takes the form of a capacitor. The charge storage device 130 stores voltage generated by the DC-DC converter 120, which may be termed a stepped-up voltage. The stepped-up voltage is higher in potential than the DC voltage produced by the DC source 110. The DC-DC converter 120 and the charge storage device 130 are also coupled with a programmable controller circuit 140. Such a controller circuit may comprise a microcontroller, or the like. For this embodiment, the controller 140 is a low-power device, which has limited current consumption, such as in the milliampere range.

The system 100 further includes a safety switch device 150, which is controlled by a safety switch control circuit 155. The safety switch control circuit 155 is coupled with the controller 140. The controller 140 may supply electrical signals to the safety switch control circuit 155, which, responsive to the electrical signals, closes the safety switch device 150 to allow current from the DC source 110 to flow through it. Conversely, if the controller 140 does not apply these electrical signals to the safety switch control circuit 155, as determined by the controller's 140 programming or due to a functional failure of the controller 140, for example, the safety switch device 150 opens so that no current flows through it. Such a situation will result in any properly operating open valves (such as gas valves in a gas appliance) coupled with the system 100 to close, thereby preventing flow (such as gas flow) through the valve(s).

As was just discussed, the safety switch device 150, when closed, allows current to flow through it from the DC source 110 to the valve control switch 160. The controller 140 is also coupled with the valve control switch 160 and effects opening and closing of the valve control switch 160 in accordance with, for example, service logic included in the controller 140. The valve control switch 160, when closed contemporaneously with the safety switch 150, allows current to flow from the DC source 110 to a valve 170. Depending on the particular embodiment, the current from the DC source 110 may "pick" (open) the valve 170. However, the DC source 110 may have insufficient current generation capability to pick the valve 170 due to the current being consumed by other components of the system 100, such as the controller 140, the safety switch control circuit 155, and holding currents being applied to other valves (to hold them open), such as is discussed in more detail below.

To overcome the limited current generation capability of the DC source 100, the system 100 comprises a valve-picking circuit 180. The valve-picking circuit 180 may take any number of forms, some exemplary embodiments of which are discussed below. Briefly, however, the valve-picking circuit 180 stores electrical energy from the DC source 110 via the controller 140. The valve-picking circuit 180 is then selectively coupled with the valve control switch 160 and the stored electrical energy in the valve-picking circuit is employed to pick the valve 170 (e.g. supply at least a part of the transient current consumed to open the valve 170 by actuating an electromagnetic solenoid in the valve). One such valve will be described below with reference to FIG. 4. The process of picking (opening) the valve results an inductive current spike occurring due to a change in magnetic resistance that occurs in the electromagnetic actuator of the valve 170. The occurrence or non-occurrence of this current spike may be detected by the controller 140 to determine whether the valve is operating as expected.

The operation of the system 100 is substantially managed by the controller 140, which contains service logic that is executed to control the operation of the safety switch control circuit 155, the valve control switch 160 and the valve-picking circuit 180, as well as monitor an electrical signal (e.g., and inductive current spike as described above) produced by the system 100 to verify proper operation of the valve 170, as is discussed in further detail below. Thus, the controller 140 detects electrical signals in the system 100 (e.g., DC power produced by DC source 110 and DC-DC converter 120 and signals associated with the valve 170 opening and closing) and, in accordance with service logic included in the controller 140, produces other electrical signals that control the operation of the system 100, including periodically verifying proper operation of the valve 170.

As part of implementing the valve operation verification function of the system 100, the system 100 further includes a current sense device 190, which is coupled between the valve picking circuit 190 and the valve control switch 160, as well as being coupled with the controller 140 (such as via an A/D port).

The controller 140 includes machine-readable instructions to monitor electrical signals produced by/with the current sense device 190 to determine whether the valve 170 is operating as expected, or whether the valve is mechanically inoperative, such as stuck in an open position. Such approaches will be discussed in further detail with respect to FIGS. 2-6. Briefly, however, when valve 170 is picked (opened) or dropped out (closed), an inductive current spike occurs in the valve and, as a result, in the current sense device 190 due to a change in the magnetic resistance of the electromagnetic actuator included in the valve 170 as result of the valve 170 being picked or dropped out (opened or closed). The current sense device 190, in cooperation with the controller 140, detects these current spikes (or the absence of them) to verify proper operation of the valve (or a malfunction in the operation of the valve).

The system 100 also includes a mechanical actuator 195 and an igniter 197, which are operationally coupled with the valve 170. Because the system 100 (including the valve picking circuit 180) operates on thermally generated electricity supplied by the DC source 110, the valve 170 must initially be opened using some other means than picking the valve 170 using the current from the valve picking circuit 180. Once the valve 170 is mechanically actuated using the actuator 195, gas emitted from the gas valve 170 (e.g., natural gas or propane) may be ignited using the igniter 197, which may be a mechanical igniter or a piezo igniter. It will be appreciated that the manual actuator 195 and igniter 197 may be implemented as separate components or may be integrated into a single mechanism. Such mechanisms are known and will not be described in detail here.

The system 100 still further includes a user display 199 that is coupled with the controller 140. The user display 199 may take the form of, for example, a liquid crystal display, a series of light emitting diodes, a speaker, or any other appropriate device for conveying device for conveying information to a user of an appliance in which the system 100 is employed. The user display 199 may be used, for example, to indicate that the controller 140 has determined that the valve 170 has mechanically failed, as may be determined using service logic included in the controller 140 for verifying the proper function of the valve 170, as was discussed above and is discussed further below.

Figure 2:
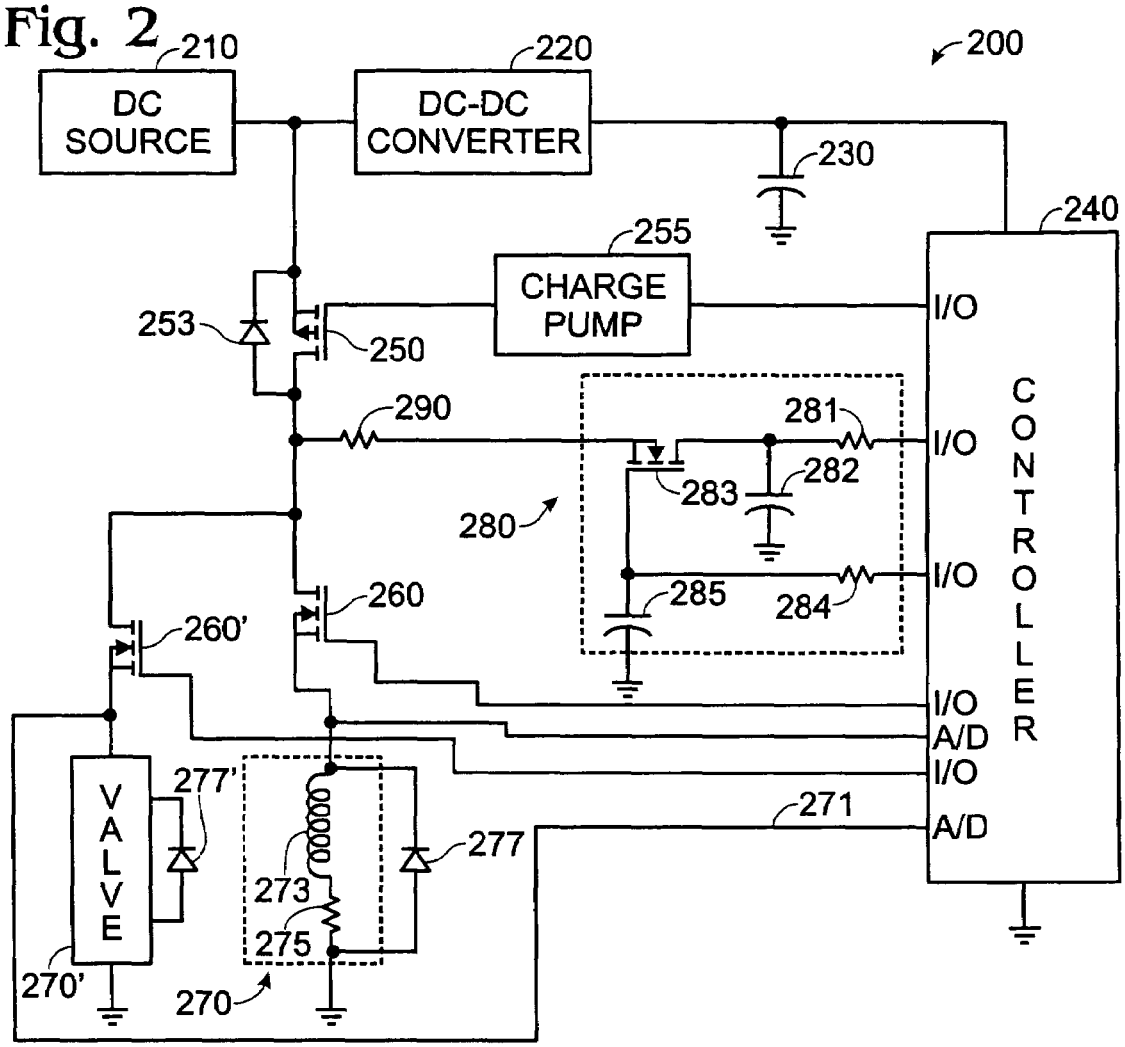
FIG. 2 is a schematic/block diagram illustrating a valve control system with automatic valve operation verification features.

Referring now to FIG. 2, a schematic/block diagram of a valve control system 200 is shown. The system 200 comprises the same basic configuration as the system 100 shown in FIG. 1. Components of the system 200 that are analogous with the components of the system 100 are referenced with corresponding 200 series reference numbers. For example, the DC source 110 of FIG. 1 is analogous with a DC source 210 of FIG. 2. For the sake of brevity, these analogous components will only be discussed with regard to any additional detail, or any differences from the previously discussed system 100 shown in FIG. 1. Also, certain components of FIG. 1 are not shown in FIG. 2. It will be appreciated that these components may also be included in the embodiment shown in FIG. 2.

Furthermore, in like fashion as with the description of FIG. 1, the operation of the valve control features of the system 200 is first discussed to provide an understanding of how the system 200 is employed to open and close a valve. Then, in this context, the valve operation verification features of the system 200 are discussed.

For the system 200, the safety switch device 250 takes the form of a p-type metal-oxide semiconductor transistor (PMOS) device. Also shown in FIG. 2 is a diode 253. The diode 253 is shown to represent the intrinsic diode that is formed by the PMOS safety switch device 250. The relevance of the diode 253 to the operation of the system 200 will be discussed further below with regard to the process of picking a valve using the system 200. The safety switch control circuit 255 of the system 200 comprises a charge pump circuit coupled with a gate terminal of the safety switch device 250.

The safety switch control circuit 255 is also coupled with the controller 240, which communicates electric signals to the charge pump to generate a negative voltage that is communicated to the PMOS safety switch device 250. This negative voltage "closes" the PMOS device and allows current from the DC source 210 to flow through it. As was noted above, if the controller 240 ceases to "pump" the charge pump of the safety switch control circuit 255, the PMOS safety switch device 250 will open and current from the DC source 210 will not be able to flow through it. In this situation, any properly operating open valves of the system 200 will close (e.g. stopping the flow of gas in a gas-powered appliance).

The valve control switch 260 of the system 200 takes the form of an n-type metal-oxide semiconductor (NMOS) device. The valve control switch 260 is coupled with the controller 240, such that an electrical signal from the controller 240 effects "opening" and "closing" of the NMOS valve control switch 260. Closing the NMOS valve control switch 260 contemporaneously with the PMOS safety switch device 250 allows current to flow from the DC source 210 to the valve 270 of the system 200. The valve 270 comprises an inductor 273 and a resistor 275, which represent the inductance and resistance of a solenoid of the valve 270. A diode 277 is also coupled with the valve 270. The diode 277 is a so-called "freewheeling diode", which provides a current path for any current stored in the inductor 273 when the valve 270 is transitioned from an open state to a closed state (which results in an inductive current spike associated with a valve dropping out).

The system 200 also comprises a second valve control switch 260' (also in the form of an NMOS device), a second valve 270' and a second freewheeling diode 277', which are coupled in parallel with the NMOS valve control switch 260, the valve 270 and the freewheeling diode 277. The first valve 270 and the second valve 270' may be, respectively, a pilot valve and a main burner valve in a gas appliance, such as a water heater.

When the DC-DC converter 220 has generated a voltage on capacitor 230 (by stepping up the initial DC voltage produced by the DC source 210) that is greater than an operational threshold for the controller 240, the controller 240, which monitors this voltage, will begin to charge the capacitor 282. The resistive-capacitive charge storage circuit is charged by electrical energy from the capacitor 230 (and the DC-DC converter 220) via the controller 240. To effect such charging, an output driver of an input/output signal pin (I/O or I/O pin) of the controller 240 is activated (e.g. set to an "OUTPUT HIGH" state). In this configuration, current flows from the capacitor 230, through the controller 240 and through the resistor 281 to charge capacitor 282. In this particular embodiment, the capacitor 282 is a relatively large capacitor as compared to capacitor 230.

The resistor 281 regulates (e.g., limits) the transfer of energy from the capacitor 230 (via the controller 240) to the capacitor 282. The values of the resistor 281 and the capacitor 282 are determined based on how often the controller is able to communicate electrical energy from the capacitor 230 to the valve-picking charge storage circuit without adversely affecting the functions of the controller 240. When the voltage present on the capacitor 230 decreases to a pre-determined level, the controller 240 sets the I/O pin that is coupled with the charge storage circuit to an INPUT state (e.g. high impedance), thereby effectively electrically isolating the valve-picking charge storage circuit 280 from the capacitor 230. Thus, in this embodiment, the controller 240 controls the charging of the capacitor 282 based, at least in part, on the amount of current and voltage supplied by the DC source 210 via the DC-DC converter 220.

For the system 200, the placement of the capacitor 282 offers certain advantages over other configurations, such as a configuration where the capacitor 282 is simply placed in parallel with the capacitor 230. For example, the arrangement shown in FIG. 2 allows the controller 240 to effect the use of substantially all of the energy stored in the capacitor 282 for valve picking. This is accomplished by switching the I/O pin used to charge the capacitor 282 to the INPUT state before a valve is picked (opened). Thus, if the capacitor 282 is deeply discharged while picking a valve, the resultant low voltage state on the capacitor 282 will not affect the controller 240's supply voltage, as would be the case if the capacitor 282 was connected in parallel with the capacitor 230.

For a configuration where the capacitor 282 is placed in parallel with 230, the controller 240 could only use a portion of the energy stored in the capacitor before affecting the functionality of the controller 240 (by causing the supply voltage of the controller 240 to fall below an operating threshold of the controller 240). In this situation, the residual energy in 282 (to maintain the controller 240's supply voltage above the operating threshold) would typically not be used for picking a valve.

The valve-picking circuit 280 further comprises a valve-picking switch 283, which takes the form of an NMOS device for this embodiment. A gate terminal of the NMOS valve-picking switch 283 is coupled with a resistive-capacitive current control circuit that includes a resistor 284 and a capacitor 285. The current control circuit is configured such that the capacitor 285 maintains a substantially constant voltage level on the gate of valve-picking switch 283. The resistor 284 regulates charging of the capacitor 285, which is used for driving the gate of the valve-picking switch 283.

When it is desired to pick a valve, such as the valve 270', the controller 240 sets an I/O pin coupled with the valve-picking-switch 283 (via resistor 284) to an OUTPUT HIGH state, which charges the capacitor 285 to turn on the valve-picking switch 283. The electrical energy stored on the capacitor 282 is then communicated to the valve 270'. Using an analog to digital (A/D) converter included in the controller 240, the controller 240 senses and/or monitors the voltage on the valve coil, which is present on a signal line 271 of the system 200.

When the A/D converter senses that the valve coil voltage has reached a pre-determined level, the controller 240 sets the I/O pin coupled with the valve-picking switch 283 (via the resistor 281) to the INPUT state, effectively electrically isolating the capacitor 285 from power supply voltage of the controller 240 (and from DC-DC converter and the capacitor 230). The capacitor 285 then holds the voltage level on the gate of the valve-picking switch 283 substantially constant and, thus, keeps the voltage on the valve coil substantially constant at the desired level as charge will continue to be communicated from the capacitor 282 to the valve 270'. Communicating this charge results in a gradual current increase in the valve solenoid, which further results in the movement of the solenoid actuator giving feedback in the form of an inductive current spike in the valve 270'. This may be detected by the A/D port of the controller 240 coupled with the current sense device 290 (which takes the form of a resistor) as an indication that the valve 270' has opened.

Once picking of the valve 270' is effected, the controller 240 then sets the I/O pin coupled to the gate of the valve-picking switch 283 (via the resistor 281) to an OUTPUT LOW state (e.g. electrical ground) to discharge the capacitor 285 and, as a result, decouple the valve-picking charge storage circuit from the valve 270'. Therefore, the current control circuit, at least in part, controls the operation of the NMOS valve-picking switch 283 responsive to electrical signals from the controller 240, so that an adequate level of valve-picking current is delivered to the valve coil of the valve being picked.

The electrical energy stored on the capacitor 282 may be supplied to either valve 270 or 270' to pick (open) the valve(s). The voltage on the valve coil of the valve 270 or the valve 270' is monitored and controlled by the controller 240 when picking the valve so as not to supply a picking current that increases the voltage present at the drain terminal of the NMOS valve control switches 260 and 260' beyond the point that would forward bias the intrinsic diode 253 of the PMOS safety switch device 250. It will be appreciated that the voltage to forward bias the intrinsic diode 253 would be approximately the junction voltage of the diode 253 plus the voltage of the DC source 210.

Such a situation would result in current from the valve-picking circuit 280 flowing through the diode 253 back to the DC source 210, in addition to the current flowing through the valve control switch 260 or 260' to pick valve 270 or 270', thus reducing the amount of electrical energy available to pick the valve. It will be appreciated, however, that the voltage on the valve 270 or 270' must be of a high enough potential to allow a sufficient amount of current to be generated, so as to pick the valve. In this regard, as an example, the voltage on the valve 270' is sensed via signal line 271 by another A/D channel included in the controller 240. Alternatively, such A/D converters may be external to the controller 240. Controller 240 may then control the voltage present at the valve 270' by controlling an electrical signal supplied to the gate of the valve-picking switch 283 based on the sensed voltage.

For the system 200, as noted above, the current sense device 290 takes the form of a resistor. The resistor is coupled between the valve picking circuit 280 and the valve control switches 260 and 260'. The resistor is also coupled between the valve picking circuit 280 and the safety switch 250. The controller 240 includes service logic (machine-readable instructions) for detecting an inductive current peak that occurs across the resistor when the valve 260 is picked (opened). For this embodiment, the inductive current peak is detected using a signal line 272 connected with an A/D port of the controller 240. Alternatively, the current sense device 290 (the resistor) could be located below the valve 270 in Figure two, with the diode 277 being connected in parallel with the series combination of the current sense device 290 and the valve 270. In such a configuration, the diode's anode would be coupled to ground and the diode's cathode would be coupled to the circuit node connecting the valve 270 to the valve control switch 260. Additionally in this approach, the signal line 272 would be coupled with an A/D channel of the controller 240 and a connection point between the valve 270 and the resistor.

For purposes of this discussion, it will be assumed that the valve 270 is a pilot burner valve and the valve 270' is a main burner valve in a water heater appliance. Also for purposes of this discussion, it is assumed that the valve 270 has been mechanically actuated, a pilot flame has been ignited and that the DC-source 210 is supplying sufficient power to operate the system 200. Furthermore, in this illustration, it is assumed that the valve 270' is closed and the main burner flame is off. Given the above assumptions, the proper operation of the valve 270 may be determined by the system 200 by "cycling" the valve 270 (e.g., closing and opening the valve). The valve is cycled by first opening the valve control switch 260 to drop out (close) the valve 270 and then re-opening the valve 270 by picking the valve using the valve picking circuit 280 in the manner that was previously described.

When the valve 270 is cycled, proper operation of the valve 270 is indicated by inductive current spikes that occur both when the valve is dropped out (closed) and again when the valve is picked (open). In a typical electromagnetic valve, the inductive current peak associated with picking the valve is greater in amplitude than the peak associated with dropping out the valve due to the electromagnetic characteristics of such valves.

Therefore, in system 200, employing such a valve for a standing (normally open) pilot valve, e.g., the valve 270, verifying that the valve 270 will close (to ensure that corrosion or some other factor has not caused the valve to be stuck open) may be accomplished by signaling the valve to close and then picking the valve in the manner described above. When the valve 270 is picked, the controller 240 monitors the voltage present on the signal line 272 using the A/D channel of the controller 240.

Based on the occurrence of a current peak within an expected range (represented by a corresponding voltage variation across the current sense device 290), the controller 240 determines that the valve closed properly because the valve re-actuated in response to being picked. In the event that a current peak within the expected range does not occur (based on the voltage signal present on the signal line 272 during picking), the controller 240 determines that the valve 270 did not close, as the valve 270 did not actuate in response to being picked. It is noted that if the valve 270 were to stick in the closed position, the pilot flame would be extinguished and the controller 240 would not operate as the thermally activated DC source 210 would not generate any electrical power. Alternatively, the current peak associated with dropping out the valve 270 could be monitored by the controller 240 to verify proper operation of the valve 270. However, due to the larger amplitude of the current peak associated with picking the valve 270, detecting the current peak associated with picking the valve 270 may provide a more reliable approach to verifying proper operation of the valve 270. It will be appreciated that a similar approach may also be used to verify the operation of the main burner valve 270' by sensing the occurrence of an inductive current spike on the signal line 271.

Figure 3:
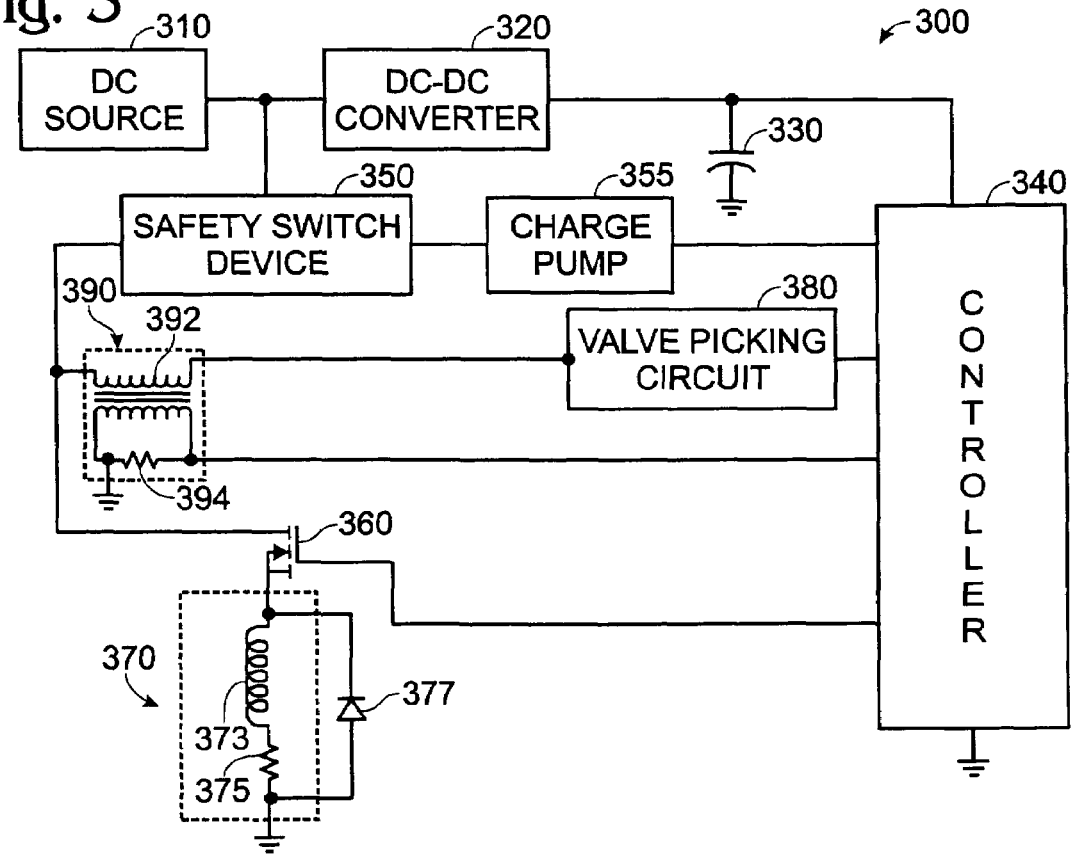
FIG. 3 is a schematic/block diagram illustrating another valve control system with automatic valve operation verification features.

Referring now to FIG. 3, a schematic/block diagram illustrating an alternative valve control system 300 is shown. The system 300 is similar to the systems 100 and 200 and analogous elements are referenced with like 300 series reference numbers. The analogous elements of the system 300 are not described in detail here except to note the differences between the system 300 and the systems 100 and 200. Specifically, the current sense device 390 of the system 300 takes the form of a transformer 392 and a resistor 394. The primary winding of the transformer 392 is coupled in a similar fashion as the resistor current sense device 290 of the system 200. The terminals of the secondary winding of the transformer 392 are coupled together via the resistor 394, with the upper terminal also being coupled with the A/D port of the controller 340. In this particular embodiment, the transformer 392 is a step up transformer (has fewer primary turns than secondary turns), which results in amplification of electrical signals associated with the current peaks corresponding with dropping out and picking the valve 370, thus making those current peaks more readily detectable. Of course, other current sensing devices may be used in the systems illustrated in FIGS. 1-3, such as an inductor or a current sensing circuit.

Figure 4:
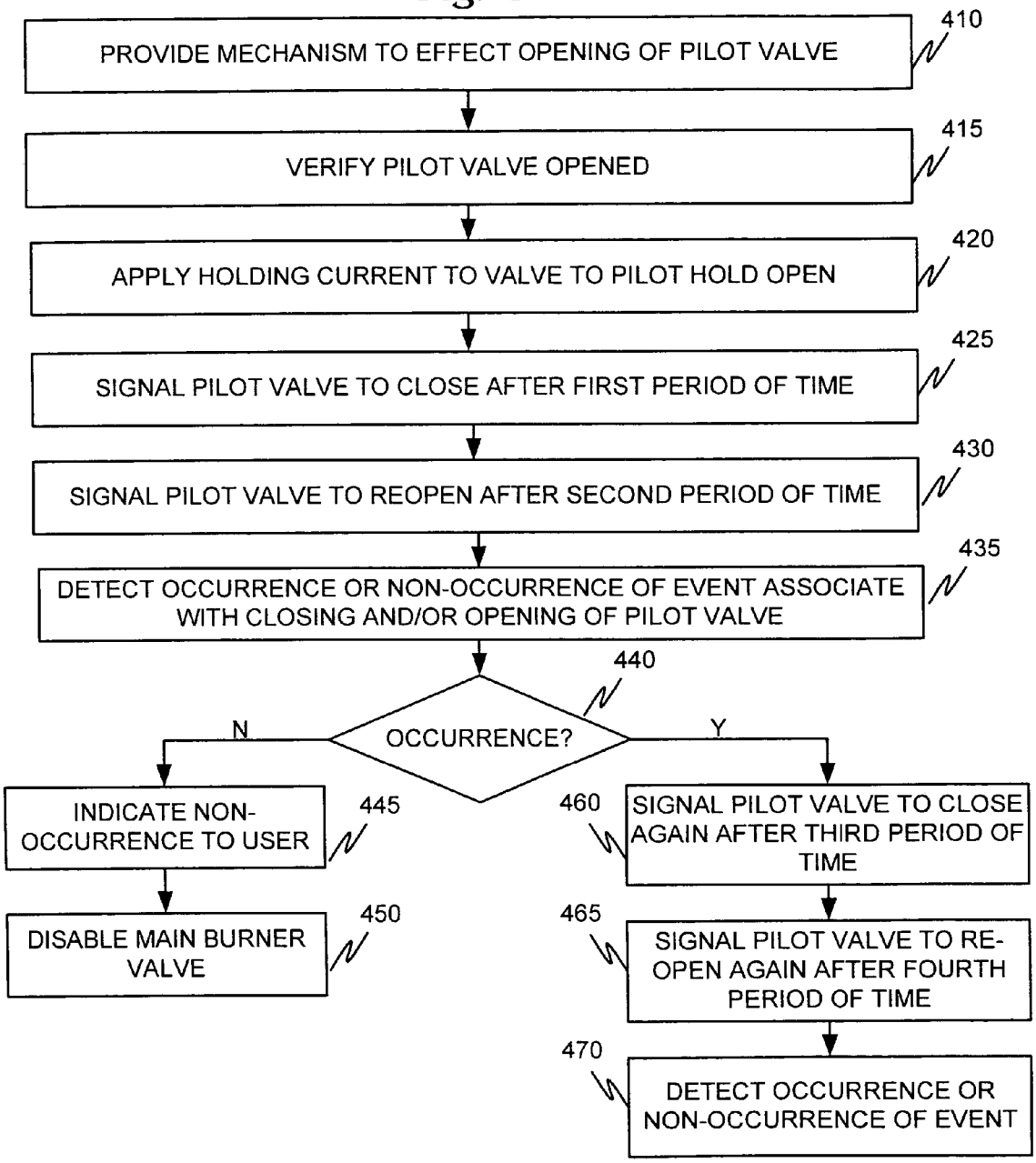
FIG. 4 is a flowchart illustrating a method of automatically verifying operation of a standing valve.

Referring now to FIG. 4, a flowchart illustrating a method for verifying the operation of an electromagnetic valve, such as in a gas-powered appliance, is shown. The method of FIG. 4 is discussed with further reference to FIG. 1. It will be appreciated that the system 100 illustrated in FIG. 1 may include one or more additional valves (e.g., a main burner valve) in like fashion as the system 200 in FIG. 2. The method includes, at block 410, providing a mechanism to open a pilot valve, which may include igniting a pilot flame, such as was described with regard to the mechanical actuator 195 and the igniter 197 of FIG. 1. Alternatively, the pilot light may be ignited using an external ignition source, such as a match or butane lighter. The method then includes, at block 415, verifying that the pilot valve is opened. As was described above, this may be accomplished by the controller 140 detecting a voltage signal produced by the thermally activated DC source 110. The presence of this voltage signal indicates that the pilot valve is open and that the pilot flame is ignited.

The method then includes, at block 420, applying a holding current to the pilot valve to hold the valve open to operate in a standing pilot mode. The holding current for the system 100 is applied by the DC source 110 via the safety switch device 150 and the valve control switch 160.

After a specific first period of time, which may be measured using service logic included in the controller 140 or, alternatively, using a separate timer circuit (not shown), the operation of the pilot valve may be verified. This time period may vary. For example, verifying proper operation of the pilot valve could be performed every day, once a week, once a month, or could be checked more or less frequently. In order to verify the proper operation of the pilot valve, the system 100 (using the controller 140), at block 425, signals the pilot valve to close once the first time period has elapsed. For the system 100, the controller signals the pilot valve to close by opening the valve control switch 160, which removes the holding current from the valve.

At block 430, the method includes signaling the pilot valve to reopen after a second period of time has elapsed. The second period of time is selected such that the actuator will finish moving to closed position, but the pilot light flame does not completely go out. It is noted that completely extinguishing the pilot flame would likely cause the system 100 to stop functioning as a result of the loss of power from the thermally generated source. Therefore, the second period of time is relatively short as compared to the first period of time, such as on the order of 20 ms, 40 ms or 50 ms. Signaling the valve to reopen in the system 100 comprises picking the valve in the manner described above with reference to FIG. 2.

The method of FIG. 4 further includes, at block 435, detecting the occurrence or non-occurrence of an event associated with closing and/or re-opening the pilot valve, such as the inductive current peaks described above. For the system 100, the controller 140 makes a decision based on whether or not such an event was detected using service logic included therein. If the event was not detected, the method continues to block 445 where an indication that improper functioning of the pilot valve has been detected is provided to a user of the appliance, such as using the user display 199 of FIG. 1, as was discussed above. The method then continues to block 445 where the main burner valve is disabled to prevent the possibility that the main burner may turn on when the pilot valve is stuck in the open position. The main burner valve may be disabled using the service logic included in the controller 140 by, for example, setting a software flag to indicate that the main burner valve should not be picked. Such a flag may also be stored in non-volatile memory of controller 140, allowing the controller 140 to retain information about the fault after a power loss or power disconnection. Of course, any other appropriate technique may be employed to disable the main burner, such as opening the safety switch device, thus disconnecting the DC source 110 from the valve control switch 160.

If the controller 140 detects the occurrence of an event indicating the proper operation of the pilot valve (e.g., the inductive current spikes associated with picking and/or dropping out the pilot valve), the method of FIG. 4 continues on to block 460 from decision block 440. At block 460, the pilot valve is again signaled to close after a third period of time has elapsed. The third period of time may be equivalent with the first period, or may be another period of time. At block 465, the pilot valve (e.g., using the controller 140) is signaled to open again after a relatively short period of time has elapsed, so as not to extinguish the pilot flame and result in the loss of function of the valve control system.

Figure 5:
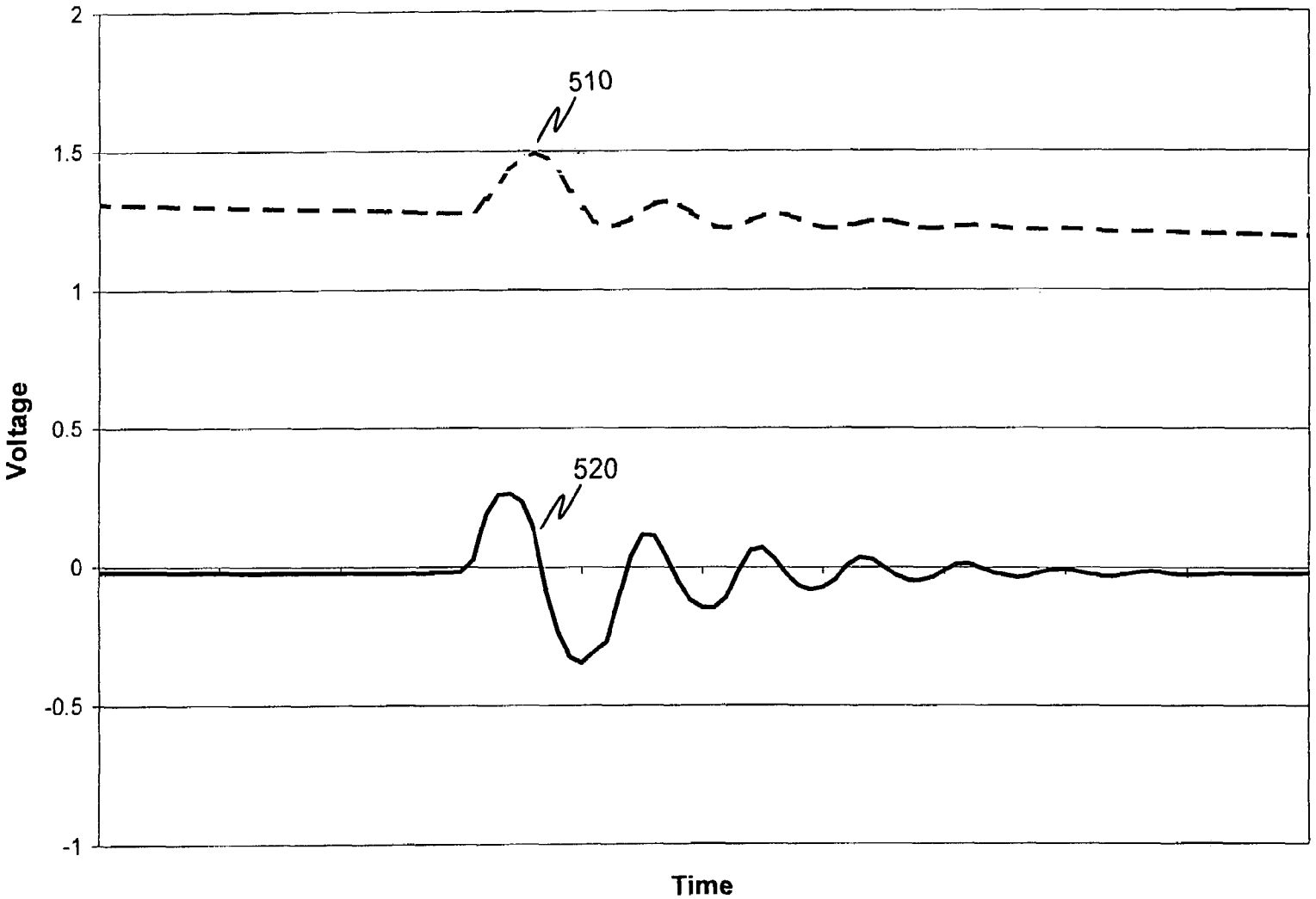
FIG. 5 is a graph showing signal traces associated with the closing a valve.
Figure 6:
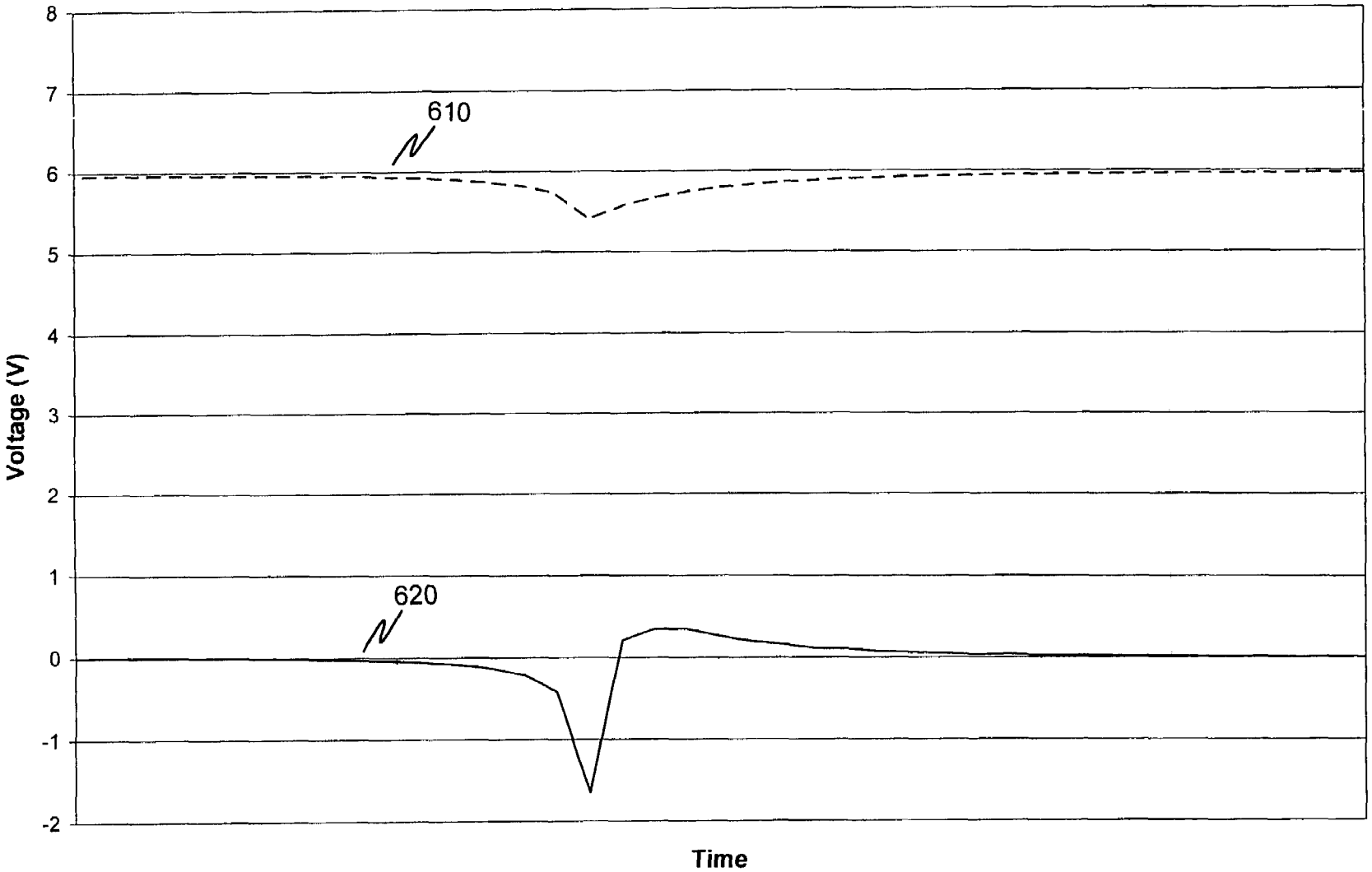
FIG. 6 is a graph showing signal traces associated with opening a gas valve.

Referring now to FIGS. 5-6, graphs are shown that illustrate the inductive voltage peaks associated with dropping out and picking an electromagnetic valve, such as in a valve control system as those previously described. FIG. 5 illustrates, with traces 510 and 520, the inductive current spike (converted to voltage by a current sense device) associated with dropping out (closing) a valve, while FIG. 6, with traces 610 and 620 illustrates the inductive current spike (converted to voltage by a current sense device) associated with the picking of a valve. It is noted the amplitude of the signal associated with picking (opening a valve) (FIG. 6) is much greater than the signal associated with closing the valve (FIG. 5). Thus, detecting the opening of a valve may be easier to accomplish to verify proper valve operation.

CONCLUSION

Various arrangements and embodiments have been described herein. It will be appreciated, however, that those skilled in the art will understand that changes and modifications may be made to these arrangements and embodiments without departing from the true scope and spirit of the invention, which is defined by the following claims.

What is claimed is:

1. A method of verifying proper operation of an electromagnetic valve, the method comprising:

providing a mechanism to effect opening of the valve;

verifying that the valve opened as a result of employing the mechanism to effect opening of the valve;

after verifying the valve opened, signaling the valve to close after a first period of time has elapsed;

after signaling the valve to close, signaling the valve to re-open after a second period of time has elapsed, wherein the second period of time is short enough that a flame ignited with gas emitted from the valve prior to the closing of the valve is not extinguished; and detecting the occurrence or non-occurrence of an event associated with at least one of the closing and re-opening of the valve.

2. The method of claim 1, wherein the mechanism ignites the flame in conjunction with employing the mechanism to open the valve, wherein the valve is a pilot valve, and wherein the flame is in thermal communication with a thermoelectric power supply, the power supply providing a holding current to hold the valve open.

3. The method of claim 1, wherein signaling the valve to re-open comprises applying a picking current signal to the valve.

4. The method of claim 1, further comprising applying a holding current signal to the valve to hold the valve open during the first period of time.

5. The method of claim 4, wherein signaling the valve to close comprises removing the holding current signal from the valve.

6. The method of claim 1, wherein verifying that the valve opened as a result of employing the mechanism to effect opening of the valve comprises detecting a voltage signal produced by a thermoelectric device, the voltage signal being produced with a pilot flame generated using gas emitted from the opened valve.

7. The method of claim 1, wherein detecting the occurrence or non-occurrence of the event associated with at least one of closing and re-opening of the valve comprises detecting the occurrence or non-occurrence of an inductive current peak associated with the valve closing or re- opening.

8. The method of claim 1, further comprising, in the event of detecting the occurrence or non-occurrence of an event associated with at least one of closing and re-opening of the valve, responsively providing an indication of the occurrence or non-occurrence to a user of a device in which the valve is employed.

9. The method of claim 1, wherein the first period of time is at least 24 hours.

10. The method of claim 1, where in the second period of time is less than 50 millisecond.

11. The method of claim 1, wherein in the event of detecting the occurrence or non-occurrence of the event associated with at least one of closing and re-opening of the valve, the method further comprises:

signaling the valve to again close after a third period of time has elapsed from detecting the event associated with re-opening of the valve;

signaling the valve to again re-open after a fourth period of time has elapsed from signaling the valve to close again, wherein the fourth period of time is short enough that a flame ignited with gas emitted from the valve prior to the closing of the valve is not extinguished;

detecting the occurrence or non-occurrence of an event associated with at least one of again closing and again re-opening the valve.

12. A gas powered appliance comprising:

a pilot valve;

a main-burner valve;

a thermoelectrically powered valve control circuit, wherein the control circuit comprises a storage device having executable instructions stored thereon, the instructions, when executed, provide for;

verifying that the pilot valve is opened;

signaling the pilot valve to close after a first period of time has elapsed;

signaling the pilot valve to re-open after a second period of time has elapsed, wherein the second period of time is short enough that a flame ignited with gas emitted from the pilot valve prior to the closing of the valve is not extinguished;

detecting the occurrence or non-occurrence of an event associated with at least one of the pilot valve closing and the pilot valve re-opening.

13. The appliance of claim 12, wherein the thermoelectrically powered valve control circuit comprises a thermoelectric power supply including a thermopile device, the thermopile device being coupled with The pilot valve to provide a holding current signal to the pilot valve to hold the pilot valve open during the first period of time.

14. The appliance of claim 12, wherein the instructions, in the event of detecting the occurrence or non-occurrence of The event associated with at least one of closing and re-opening of the pilot valve, further provide for:

responsively providing an indication of the occurrence or non-occurrence to a user of the appliance.

15. The appliance of claim 12, wherein the instructions, in the event of detecting the occurrence or non-occurrence of the event associated with at least one of closing and re-opening of the pilot valve, further provide for:

disabling operation of the main-burner valve.

16. The appliance of claim 12, wherein the instructions, in the event of detecting the event associated with at least one of closing and re-opening of the pilot valve, further provide for:

signaling the pilot valve to again close after a third period of time has elapsed from signaling the pilot valve to re-open;

signaling the pilot valve to again re-open after a fourth period of time has elapsed from signaling the valve to again close wherein the second period of time is short enough that a flame ignited with gas emitted from the pilot valve prior to the closing of the valve is not extinguished; and detecting the occurrence or non-occurrence of an event associated with at least one of the closing again and re-opening again of the pilot valve.

17. The appliance of claim 12, wherein the instructions for detecting the occurrence or non-occurrence of the event associated with re-opening of the valve comprise instructions that provide for detecting the occurrence or non-occurrence of an inductive current peak associated with the valve re-opening.

18. The appliance of claim 12, wherein the storage device comprises a programmable controller, wherein the controller, in operation, executes the instructions stored thereon.

19. A valve system for use in a gas powered appliance, the system comprising:

a thermoelectric power supply;

a programmable controller coupled with the thermoelectric power supply;

a current source supplying a valve picking current, The current source being coupled with the controller;

a current sense device coupled with The power supply and the controller;

a valve control switch coupled with the controller and the current sense device; and a valve coupled with the valve control switch, wherein the controller, in operation;

determines that the valve is open;

signals the valve control switch to effect closing the valve after a first period of time;

signals the valve control switch and the current source to effect re-opening the valve after a second period of time, wherein the second period of time is short enough that a flame ignited with gas emitted from the valve prior to the closing of the valve is not extinguished; and determines whether the valve re-opened by sensing a voltage potential change across the current sense device, wherein the voltage potential change is a result of an inductive current peak in the valve.

20. The valve system of claim 19, wherein the thermoelectric power supply comprises:

a thermopile device in thermal communication with a pilot valve flame;

a direct-current to direct-current (DC-DC) converter and a charge storage device.

21. The valve system of claim 20, wherein the DC-DC converter comprises a step-up converter.

22. The valve system of claim 19, further comprising a safety switch device coupled between the power supply and the current sense device, wherein the safety switch device is controlled by the controller.

23. The valve system of claim 22, wherein the controller controls the safety switch device via a safety switch control circuit comprising a charge pump circuit.

24. The valve system of claim 19, wherein the current sense device comprises a resistor.

25. The valve system of claim 19, wherein the current sense device comprises a transformer, wherein a primary winding of the transformer is coupled between the power supply and the current sense device and a secondary winding of the transformer is coupled with the controller.

* * * * *